United States Patent [19]

Kennedy, Jr. et al.

[11] 4,037,896

[45] July 26, 1977

[54] TRAY SLIDE AND SUPPORT THEREFOR

[75] Inventors: Robert J. Kennedy, Jr.; Kendall S. Smith, II, both of West Lafayette, Ind.

[73] Assignee: Lincoln Manufacturing Company, Inc., Fort Wayne, Ind.

[21] Appl. No.: 627,145

[22] Filed: Oct. 30, 1975

[51] Int. Cl.[2] ..... A47B 96/18; A47B 5/00

[52] U.S. Cl. ..... 312/281; 312/140.3; 108/159; 108/47; 248/293

[58] Field of Search ..... 312/281, 140.4, 140.3; 248/250, 240, 248, 242, 293; 297/417; 108/47, 93, 115, 90, 159; 160/369, 368

[56] References Cited

U.S. PATENT DOCUMENTS

| | | | |
|---|---|---|---|
| 1,338,833 | 5/1920 | Kornsweet | 312/281 |
| 1,677,764 | 7/1928 | Gloekler | 312/140.4 |
| 1,892,687 | 1/1933 | Teufel | 248/293 |
| 2,253,825 | 8/1941 | Tully | 108/159 |
| 2,736,464 | 2/1956 | Walton | 312/140.3 |
| 2,886,395 | 5/1959 | Cahn | 312/281 |
| 3,094,848 | 6/1963 | Albrecht | 108/159 |
| 3,106,296 | 10/1963 | Walsh et al. | 108/159 |
| 3,113,531 | 12/1963 | Barnard | 248/293 |
| 3,124,400 | 3/1964 | Nelson | 312/281 |
| 3,283,804 | 11/1966 | Yancey | 160/368 R |
| 3,795,379 | 3/1974 | Gray | 248/242 |
| 3,908,564 | 9/1975 | Miller et al. | 108/159 |

FOREIGN PATENT DOCUMENTS

| | | | |
|---|---|---|---|
| 1,177,683 | 1959 | France | 248/242 |

*Primary Examiner*—Paul R. Gilliam
*Assistant Examiner*—Victor N. Sakran
*Attorney, Agent, or Firm*—Albert L. Jeffers; Roger M. Rickert

[57] ABSTRACT

A tray slide and a support therefor, especially for a serving counter module, in which the tray slide consists of a support bracket arrangement tiltably connected to one side of the module, and which support bracket arrangement is adapted detachably to receive a tray slide member, preferably formed of plastic, from above. The support bracket arrangement can be locked in position in which the tray slide is horizontal for receiving trays of it can be released and tilted downwardly at the side of the module for movement of the counter from place to place and through doorways.

4 Claims, 3 Drawing Figures

TRAY SLIDE AND SUPPORT THEREFOR

The present invention relates to a tray slide and a support arrangement therefor, especially for a serving module, and is particularly concerned with an arrangement which can be collapsed downward against the side of the module for movement of the latter.

Serving modules are widely employed in connection with the serving of foods and the like in cafeterias and similar establishments with the module ordinarily comprising a unit having arrangements at the top for supporting containers of foodstuffs or having wells formed therein into which foodstuffs can be placed.

Such serving arrangements normally require individuals to be served to move along the serving arrangement with a tray which is slidably supported on a tray slide arrangement projecting laterally from the serving arrangement.

When the modules are of the portable type, as is often the case, it is required to move the modules from place to place, and any rigidly mounted tray slide arrangement would, in such an instance, represent a disadvantage because the module would then be too wide to go through doorways and would be difficult to move about.

It is, also, the case that sanitary requirements dictate such construction of tray slides and the like that they can readily be cleaned and maintained in a highly sanitary condition at all times.

With the foregoing in mind, a primary object of the present invention is the provision of a tray slide arrangement for a serving counter which has one stable position in which the tray slide extends horizontally for supporting trays and has another stable position in which the tray slide is folded down against the side of the serving counter.

Another object is the provision of a tray slide arrangement, especially for a portable serving module, in which the tray slide arrangement comprises a relatively open framework tiltably supported on the side of the module and having a tray support element, preferably formed of plastic, and detachably mounted on the frame.

BRIEF SUMMARY OF THE INVENTION

According to the present invention, a serving counter for the dispensing of foodstuffs and the like, and which may be in the form of a portable module having wheels thereon, is provided and projecting laterally from one side thereof is a tray slide arrangement for supporting trays which are moved along the serving counter when food is being dispensed.

According to the present invention, the tray slide arrangement is in the form of an open framework pivotally connected to the side of the serving counter and adapted for having a tray support member detachably mounted on the upper side thereof with the tray supporting member advantageously being formed of plastic material.

The support frame includes a pair of spaced rail members which may be tubular elements, preferably of stainless steel, parallel to the length of the serving counter which are interconnected by brackets spaced along the tubular elements and welded thereto and extending perpendicularly to the adjacent side of the serving counter. The tray support member which, as mentioned, is preferably of a plastic material, has front and back edges which are curved downwardly so that the tray support member can be snapped over, or removed from, the tubular elements of the support frame.

The aforementioned brackets include at least two along the length of the support frame which cooperate with hinge elements mounted on the serving counter and which are so arranged that the support framework can be held in such a position as to hold the tray support member horizontally to be folded downwardly against the adjacent side of the serving counter.

The exact nature of the present invention will become more apparent upon reference to the following description taken in connection with the accompanying drawings in which.

DETAILED DESCRIPTION OF THE INVENTION

Figure 1:
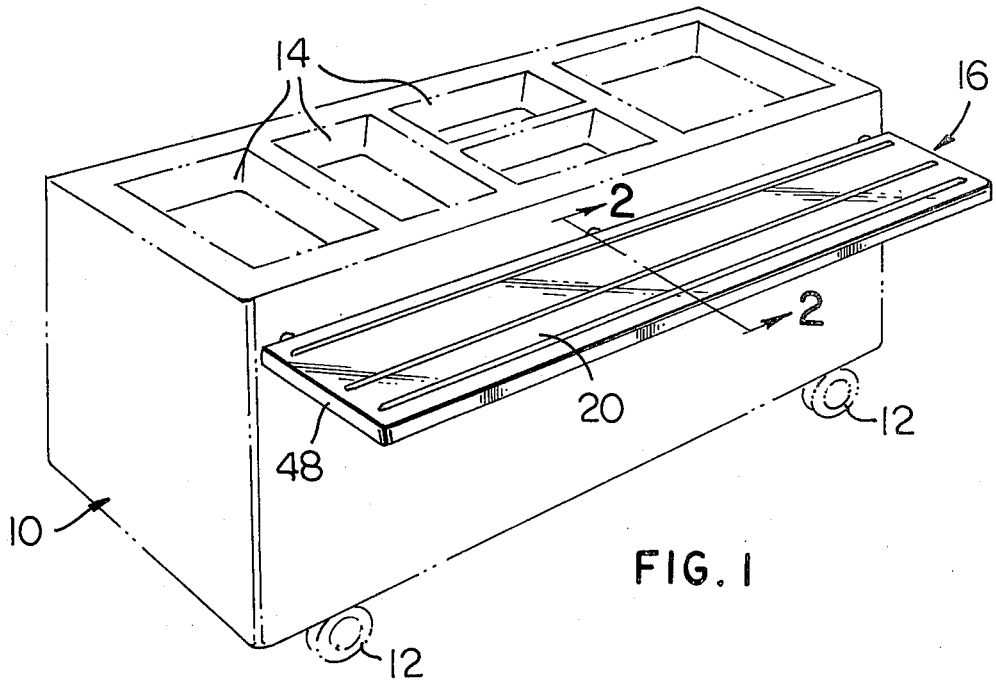
FIG. 1 is a perspective view of a serving counter in the form of a portable module and having a tray slide arrangement according to the present invention attached thereto.

Referring to the drawings somewhat more in detail, the serving counter 10 of FIG. 1 is in the form of a module having support wheels 12 so that it can be moved about. The serving counter has well means 14 distributed over the top thereof and adapted for receiving food containers or for receiving foodstuffs. The wells are, advantageously, heated where the foodstuffs are hot in any conventional manner known in the art.

A serving counter of the nature disclosed embodies an elongate tray slide for supporting trays as they are moved along the counter. The elongate tray slide according to the present invention is indicated generally at 16 and will be seen in FIG. 2 to comprise an underneath framework 18 and a tray slide member 20 mounted thereon.

The underneath framework 18 comprises spaced rail members which are preferably elongate stainless steel tubular elements 22 and 24 and bracket members 26, which also can be stainless steel, extending perpendicular to tubular elements 22 and 24 and welded thereto.

The bracket members 26 are distributed longitudinally along the tubular elements to provide the proper support therefor and at the upper edges 28 are adapted to engage the underneath side of tray support member 20.

It has been mentioned that the tray slide arrangement is adapted for being tilted downwardly and to this end at least two of the bracket members 26 for each tray support arrangement are provided with vertical slots 30 in the edges adjacent the serving counter 10. Fixedly attached to the serving counter 10, as by being bolted to the framework thereof, are other hinge elements 34 to which are connected pins or studs 36 that extend into the slots 30 in the bracket members 26.

Figure 2:
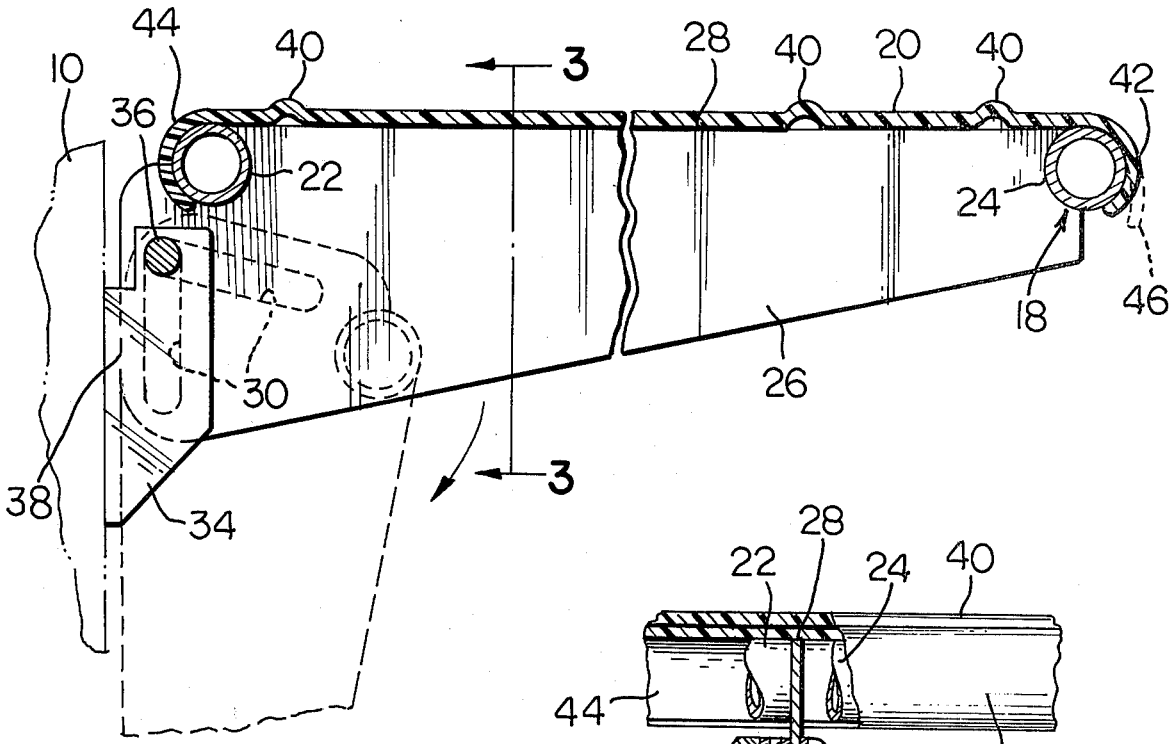
FIG. 2 is a transverse vertical sectional view through the tray slide arrangement and is indicated by line II—II on FIG. 1.
Figure 3:
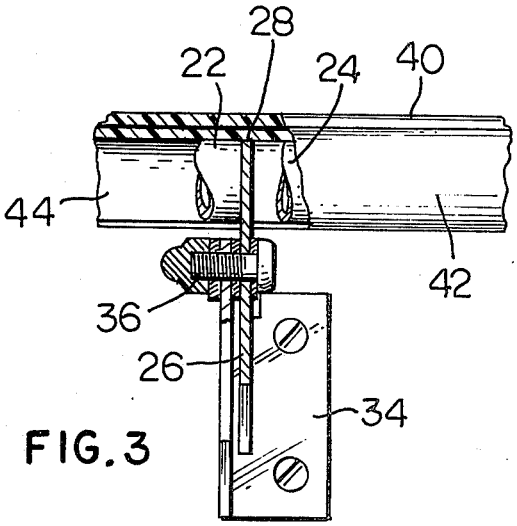
FIG. 3 is a fragmentary vertical sectional view indicated by line III—III on FIG. 2.

Each bracket member 26 has an abutment region 38 thereon which abuts the hinge element 34 when the tray support arrangement is in its FIG. 2 position. The tray support arrangement can, however, be collapsed downwardly to the dotted line position in which it is shown in FIG. 2 by lifting the tray support arrangement upwardly to bring the lower end of each slot 30 against the underside of the respective pin 36 whereupon the tray slide can be tilted downwardly as shown in dot-dash line in FIG. 2.

An important part of the present invention is the configuration of the tray support member 20 which is, as mentioned, advantageously formed of plastic material which is relatively hard and wear resistant but which is possessed of a certain amount of resilience. Suitable materials for forming the tray support 20 would include ABS, acrylocile-butadiene-styrene, PVC, polyvinyl chloride, high impact styrene, and the like.

Between the front and back edges of the tray support member 20, the member is formed with upstanding longitudinally extending ribs 40 which provide those regions of the tray support member which are engaged by the bottom of the tray. This prevents scratching of the top of the tray support members and makes it easier to move the tray therealong.

The front and back extremities of the tray support member are curved downwardly as at 42 and 44 so as to embrace a circumferential region of the respective tubular elements 22 and 24 of about 130 degrees. The plastic material is somewhat resilient so that the support member 20 can readily be snapped into the support frame and, likewise, the support member can be removed from the frame by pulling upwardly thereon at the edges.

In FIG. 2, the dot-dash outline at 46 indicates a possible amount that the adjacent curved extremity 42 of the support member 20 would have to deflect if the rearward edge at 44 were first engaged with tubular element 22 and then the front edge were to be snapped downwardly over tubular element 24.

The tray support member 20 may comprise dependent end portions 48, one of which is seen in FIG. 1, and which dependent end portions may be separated from the curved front and back edges, if necessary, so that the front and back edges have the desired degree of flexibility.

The ends of tubular elements 22 and 24 are closed at both ends, either by caps welded thereto or by utilizing specially configured brackets 26 which extend over the ends of the tubular elements and are welded to the tubular elements. The closing of the end of the tubular elements is necessary for sanitary purposes.

The described arrangement is relatively inexpensive and is simple to use and offers the advantage of collapsibility, as referred to above.

The support member 20 can readily be removed from the support framework and cleaned top and bottom while, simultaneously, exposing the framework for easy cleaning.

It will be appreciated that the bracket members 26 can be spaced along tubular rail elements 22 and 24 as desired and that each will contribute to the support of the tray support member 20.

Where the tray support member 20 is sufficiently short, the bracket members 26 which involve hinge elements with vertical slots near the vertical rearward edges could be disposed completely at the ends of the tubular elements 22 and 24. For longer tray support members there could, of course, be further bracket members 26 provided with slots as disclosed in FIG. 2.

It will be noted in FIG. 2 that the uppermost portion of the vertical rearward edge of bracket member 26 extends upwardly above the lowermost edge of the adjacent turned down edge portion of tray support member 20. If the bracket 26 were disposed completely at the end of the tray support member, the turned down edge portion 44 could be made slightly shorter to accommodate for the upper part of the rearward edge of the bracket 26, but if the bracket 26 were intermediate the ends of the tray support member, the tray support member could have a slot formed in turned down rearward edge 44. Alternatively, the upper part of the rearward edge of bracket 24 could be formed to provide a space for turned down rearward edge 44 of the tray support member 20.

What is claimed:

1. A tray slide device, especially for a serving counter, comprising, a frame having front and back elongate rail members, and an elongate resilient tray support member having a tray support surface and dependent front and back edge portions adapted resiliently to engage said rail members of the frame for releasably holding said support member on the frame, said rail members of said frame being in the form of a pair of parallel tubular elements spaced in a substantially horizontal plane, and each edge portion of said support member is curved in cross section to embrace a portion of the periphery of the respective rail member, longitudinally spaced bracket means for perpendicularly and horizontally spacing said tubular elements and fixed thereto.

2. A tray slide device according to claim 1 in which said bracket means comprises plate elements in respective vertical planes spaced along said tubular elements, each element having an upper edge coplanar with the tops of said tubular elements for cooperation therewith in supporting said tray support member, each bracket element being fixed to the inner and lower sides of the tubular elements to expose portions of the tubular elements for engagement by the edge portions of said tray support member.

3. A tray support member according to claim 1 in which said tray support member has upwardly extending ribs formed thereon and spaced in the front to back direction.

4. A tray support member according to claim 1 in which said tray support member has a dependent portion at each end extending in the front to back direction of the member.

* * * * *